United States Patent [19]

Matsuno et al.

[11] 4,089,284

[45] May 16, 1978

[54] SLURRY VESSEL WITH DEWATERING PORTS COVERING MORE THAN TWO PERCENT OF HOLD BOTTOM

[75] Inventors: Yoshiyuki Matsuno; Tomiyasu Nohara, both of Nagasaki; Fumiaki Komatsu, Nishinomiya; Nobuyuji Imanishi, Kobe, all of Japan

[73] Assignees: Mitsubishi Jukogyo Kabushiki Kaisha, Tokyo; Kabushibi Kaisha Kobe Seikosho, Kobe, both of Japan

[21] Appl. No.: 580,471

[22] Filed: May 22, 1975

[30] Foreign Application Priority Data

May 23, 1974 Japan ..... 49-58078

[51] Int. Cl.[2] ..... B63B 35/28

[52] U.S. Cl. ..... 114/26; 210/242 R; 214/14

[58] Field of Search ..... 114/26–27; 214/14, 15 B; 37/58–59; 210/242, 258

[56] References Cited

U.S. PATENT DOCUMENTS

| | | | |
|---|---|---|---|
| 1,129,322 | 2/1915 | West | 114/26 |
| 1,150,981 | 8/1915 | Walter | 214/15 B |
| 3,578,171 | 5/1971 | Usher | 210/242 |
| 3,810,547 | 5/1974 | Shudo | 214/14 |

*Primary Examiner*—Trygve M. Blix
*Assistant Examiner*—Jesus D. Sotelo
*Attorney, Agent, or Firm*—Cushman, Darby & Cushman

[57] ABSTRACT

A slurry vessel for carrying pulverized iron ore and water slurry or the like is provided with a vacuum dewatering system that includes ports covering more than 2 percent of the hold bottom area, so that, as the slurry tends to consolidate, water can be drawn therefrom to retard the progress of consolidation.

1 Claim, 3 Drawing Figures

SLURRY VESSEL WITH DEWATERING PORTS COVERING MORE THAN TWO PERCENT OF HOLD BOTTOM

FIELD OF THE INVENTION

This invention relates to a vessel for transporting slurry, and to means for retarding consolidation of the slurry during transport thereof.

BACKGROUND OF THE INVENTION

Prior art slurry vessels have suffered from problems such that the slurry loaded therein undergoes consolidation due to the dynamic effects resulting from movement of the hull during the cruise, resulting in a marked lowering in the efficiency of unloading.

To alleviate consolidation of the slurry, various measures have heretofore been taken, such as the addition of a surface active agent as an anti-consolidation composition into the slurry, the application of forced stirring to the slurry by means of a stirrer, and the like. However, these measures are not wholly satisfactory.

SUMMARY OF THE INVENTION

The present invention overcomes the above-mentioned disadvantages of the prior art and has its object to provide a slurry vessel which can effectively retard and reduce consolidation of slurry and which is provided with means for suitably monitoring and controlling the degree of consolidation of slurry, thereby increasing the efficiency of unloading work.

Accordingly, the slurry vessel in accordance with the present invention is characterized by comprising a plurality of dewatering ports arranged on a hold for slurry-like cargoes, a vacuum tank connected to each of said dewatering ports through a pipe line, and a dewatering means including a vacuum pump connected to the upper portion of said vacuum tank through a pipe line and a drain pump connected to the lower portion of said vacuum tank through a pipe line. A particular design of dewatering port is disclosed.

The slurry vessel in accordance with the present invention is further characterized in that the gross area of the openings of the dewatering ports covers more than 2 percent of the bottom area of the hold.

The principles of the invention will be further discussed with reference to the drawing wherein a preferred embodiment is shown. The specifics illustrated in the drawing are intended to exemplify, rather than limit, aspects of the invention as defined in the claims.

IN THE DRAWING

FIG. 1 is a cutaway side view illustrating principal parts of the slurry vessel in accordance with the present invention;

FIG. 2 is a sectional view illustrating a preferred form of port means for vacuum dewatering the slurry; and FIG. 3 is a graphic representation by way of experimental example indicating effect of changing dewatering port opening gross area on alleviating consolidation of a layer presentation showing results obtained by tests in conjunction with the relationship between the ratio of area, between the gross area of opening portions 5a formed in the above-mentioned plurality of dewatering ports arranged in the hold and the bottom area in the hold, and the dewatered amount, in which the curve A indicates the dewatering in a static condition (when anchored) and the curve B indicates the dewatering in a dynamic condition (during the cruise.)

DETAILED DESCRIPTION

Figure 1:
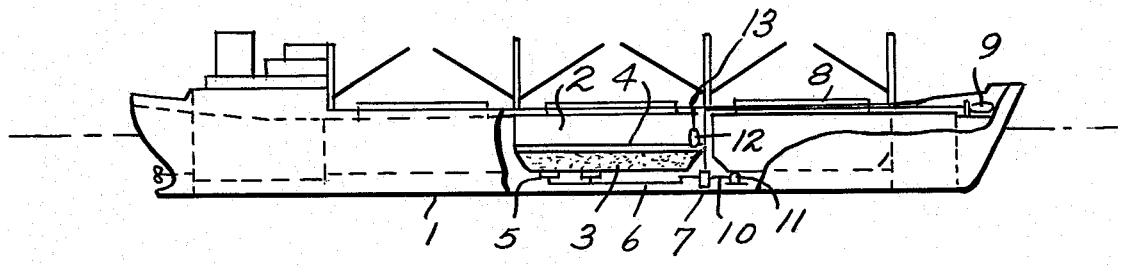
Figure 2:
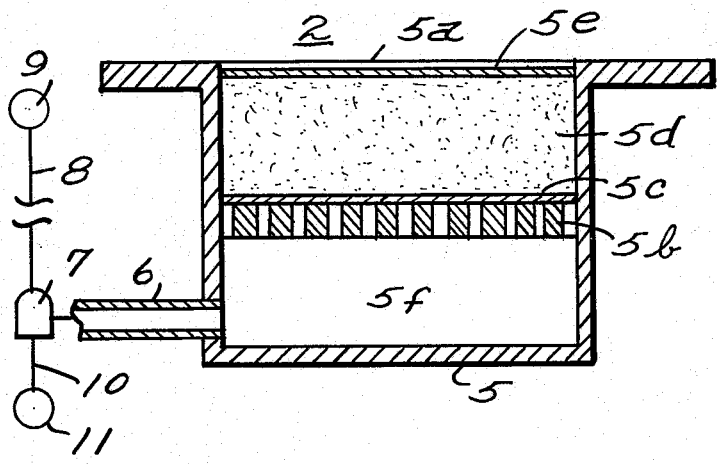

Referring now to FIGS. 1 and 2, a hold 2 disposed within the slurry vessel 1 contains a slurry-like cargo 3 and supernatant water 4 produced as the slurry-like cargo 3 precipitates. A plurality of dewatering ports 5 are arranged in the bottom and side walls of the hold 2. A pipe line 6 is shown having one end connected to the dewatering port 5. A vacuum tank 7 is connected to the end of the pipe line 6. A pipe line 8 is shown having one end connected to the top of the vacuum tank 7. A vacuum pump 9 is connected to the other end of the pipe line 8. A pipe line 10 is shown having one end connected to the lower part of the vacuum tank 7. A drain pump 11 is connected to the other end of the pipe line 10. A drain pump 12 is provided for discharging the supernatant water 4. A pipe line 13 is connected to an outlet of the drain pump 12.

The slurry-like cargoes, after being loaded in the hold 2, are gradually precipitated and concentrated, separating into a highly concentrated layer of slurry 3 and supernatant water 4, and the supernatant water 4 is then discharged outside the vessel by means of the drain pump 12 passing through the pipe line 13. On the other hand, water in the highly concentrated layer of slurry 3 is vacuum-dewatered from the dewatering ports 5 in the hold bottom through the pipe line 6, vacuum tank 7, pipe line 8 and vacuum pump 9, while water remaining within the vacuum tank 7 is discharged outside the vessel through the pipe line 10 by means of the drain pump 11.

The surface of the slurry layer falls as consolidation proceeds, and the degree of such lowering may be detected by means for detecting the upper level of the layer of slurry of any suitable type.

The operation of consolidation alleviation by way of vacuum-dewatering the slurry will now be described.

When water in the highly concentrated slurry is dewatered from the bottom of the hold by the use of vacuum-dewatering device, the following effects are produced:

(1) Increase in effective stress between solid particles,

If $\sigma_\epsilon$ is the effective stress between particles, the stress equation may be written as $$\sigma_\epsilon = \sigma_\gamma - \sigma_\rho$$

where $\sigma_\gamma$ is the total pressure (i.e. hydrostatic pressure at a given depth in the slurry layer, plus atmospheric pressure, and $\sigma_\rho$ is the pore water pressure. From this, it will be understood that when the pore water pressure (i.e. hydraulic pressure) $\sigma_\rho$ is decreased by the operation of vacuum-dewatering the effective stress $\sigma_\epsilon$ between particles increases, so that the moving resistance of the solid particles increases and as a result, re-arrangement or re-filling of the particles becomes harder to produce and the progress of consolidation caused by the dense filling of particles is alleviated.

(2) Avoidance of occurrence of liquefaction phenomenon.

If there is unsaturation between solid particles, by the operation of vacuum-dewatering (i.e. if some of the water-filled interstices have been at least partially drained so that they contain air), the liquefaction phenomenon is not exhibited, and as a result, the rearrangement of solid particles is impaired, restraining the progress of consolidation.

(3) Increase in cohesion between particles.

If there is unsaturation between particles, by the operation of vacuum-dewatering, apparent cohesion between particles caused by the capillary tension increases to increase the moving resistance of the particles, resulting in impairing the re-arrangement of solid particles.

It will be understood that significant effects upon the rate of consolidation of the slurry layer may be achieved by vacuum dewatering. The rate of consolidation generally poses no particular problem when the slurry vessel is anchored, but during the cruise the consolidation of slurry cargoes tends to proceed at an increased rate due to the dynamic effects caused by the hull movement and hull vibration, and hence, in this case, the above-mentioned means for alleviating consolidation is particularly necessary.

In consolidation control of slurry, the action of alleviating consolidation through vacuum dewatering may be utilized, by which operation the degree of consolidation of the slurry within the hold can be controlled to a suitable value.

Since it may be considered that consolidation of the slurry within the hold is produced due to the dynamic effects principally caused by the hull movement, it is not so necessary to continue operation of alleviating consolidation in the event weather conditions are calm and the dynamic effects of the hull movement are small, during the cruise.

Therefore, if the void ratio of the slurry layer can suitably be detected during the cruise, the drive of the vacuum dewatering device may be controlled according to the void ratio to bring the degree of consolidation of the slurry layer into an optimum state at the time of unloading.

Thus, means for detecting the void ratio of slurry layer is advantageously provided. The detecting means preferred measures the level of the slurry precipitation surface for the reason described hereinafter.

If $H_o$ is the thickness of slurry layer at the beginning of precipitation and $e_o$ is the void ratio thereat, the equation with respect to the suitable thickness H of the slurry layer and the void ratio $e$ may be written as $$H_o/(1 + e_o) = H/(1 + e)$$

From this, the value $e$ may be obtained by measuring H, and therefore, the vacuum dewatering device may be stopped where the void ratio is not significantly lowered, but the vacuum dewatering device may be driven where the lowering of the void ratio proceeds. The height H of slurry may be obtained by any suitable means for detecting the precipitation surface level of a layer of the slurry and the value $e$ may be further obtained from H.

From the foregoing description, it will be apparent that the present invention may provide the following effects.

Whereas, conventional slurry vessels are afflicted by marked consolidation of cargoes produced during the cruise to often extremely decrease the efficiency of unloading, the slurry vessel in accordance with the present invention comprises a vacuum tank connected to each of the dewatering ports arranged on a hold loading therein slurry-like cargoes through a pipe line, and a dewatering means including a vacuum pump connected to the upper portion of said vacuum tank through a pipe line and a drain pump connected to the lower portion of said vacuum tank through a pipe line, thereby alleviating the progress of consolidation of slurry cargoes and highly enhancing the efficiency in unloading.

As illustrated in FIG. 2, each of dewatering ports 5 is formed as a well having an opening portion 5*a*, a thick and strong perforated support member 5*b* is disposed as a "false bottom" intermediate the depth of the well construction.

Also, a screen 5*c* is disposed on the support member 5*b*, and the space in the part of the well that is above the screen 5*c* is filled with a filter medium such as iron sand or a mixture of iron, sand, and pellets, which form a layer of filtration medium 5*d*.

Further, a screen 5*e* is disposed on the filtration medium layer 5*d*, and reinforcing members (not shown) may be arranged, if necessary, on the underside of the screen 5*e*.

Under the support member 5*b* is formed a dewatering chamber 5*f*, to which one end of the pipe line 6 is connected.

The plurality of dewatering ports 5 arranged in the hold 2 is so formed that a gross area obtained by totalling areas of opening portions 5*a* covers more than 2 percent of the bottom area in the hold.

The highly concentrated layer of slurry 3 is normally formed by pulverized solids and water. If it were not for the layer 5*d*, the slurry would be sucked into the opening portion 5*a* as the pressure in the dewatering chamber 5*f* is decreased.

In that case, the dewatering chamber 5*f* and the pipe line 6 communicated therefrom to the vacuum tank 7 would become blocked because of the presence of fine particulate matter contained in the slurry, and hence it is necessary to introduce only the water in the layer of slurry into the dewatering chamber 5*f* and thereafter.

Further, the construction in the vicinity of the dewatering ports 5 forms a part of the inner wall surface in the hold, but in the event it particularly forms a part of the bottom in the hold, a bulldozer or other unloading machinery may run on the surface thereof at the time of unloading so that it should firmly be reinforced by the support member 5*b*.

Furthermore, screens 5*e* and 5*c* are provided to avoid entry of fine particulate slurry into the filtration layer 5*d* in a mixed form and entry of filter medium into the dewatering chamber 5*f*.

Figure 3:
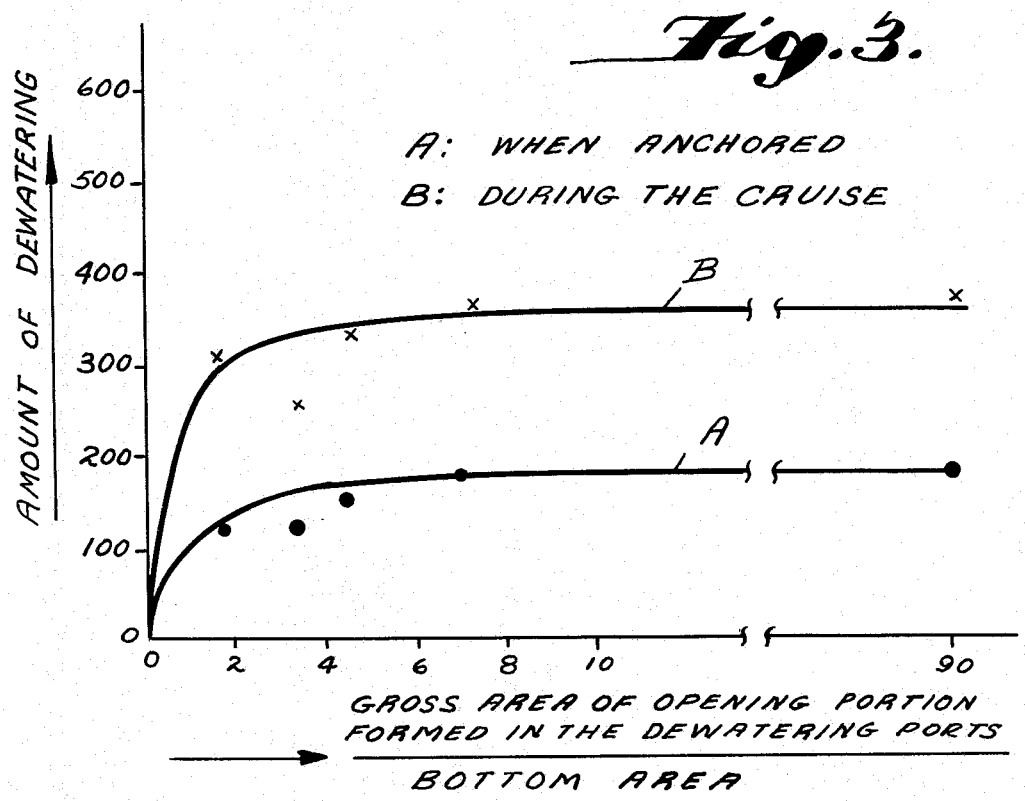

The optimum effect of alleviating consolidation based on the vacuum-dewatering of slurry may be attained when the amount of dewatering (i.e. the amount of removed water) is increased, but as is best indicated in FIG. 3, the amount of dewatering decreases greatly if the above-mentioned ratio of area is less than 2 percent. Thus, to satisfactorily attain effect of alleviating consolidation of slurry, the ratio of area must be more than 2 percent.

From the foregoing detailed description, the slurry vessel in accordance with the present invention comprises a plurality of dewatering ports 5 arranged on a hold 2 loading therein slurry-like cargoes, a vacuum dewatering system (7–9) connected to each of the dewatering ports 5 through a pipe line 6, a gross area of opening portions 5*a* of said dewatering port 5 covering more than 2 percent of a bottom area of the hold, and as a result the present invention possesses the advantages such that the slurry within the hold being transported may be sufficiently vacuum-dewatered to alleviate consolidation thereof, resulting in a considerable improvement in efficiency of handling cargoes at a port of discharge.

It should now be apparent that the Slurry Vessel With Dewatering Ports Covering More Than Two Percent of Hold Bottom as described hereinabove, possesses each of the attributes set forth in the specification under the heading "Summary of the Invention" hereinbefore. Because the Slurry Vessel With Dewatering Ports Covering More Than Two Percent of Hold Bottom of the invention can be modified to some extent without departing from the principles of the invention as they have been outlined and explained in this specification, the present invention should be understood as encompassing all such modifications as are within the spirit and scope of the following claims.

What is claimed is:

1. A process for controlling the degree of consolidation of a cargo of slurry being transported in a hold of a water-borne vessel, comprising:

sucking liquid from the slurry by means of vacuum through a plurality of openings at the bottom of the hold, the total area of said openings exceeding 2 percent of the bottom area of the hold, so that a layer of said slurry becomes unsaturated by partly replacing water within the slurry layer by air, whereby contact pressure between slurry particles is increased, displacement and rearrangement of the particles become difficult, and thus consolidation of the slurry is prevented.

* * * * *